US012339054B2

(12) United States Patent
Li et al.

(10) Patent No.: US 12,339,054 B2
(45) **Date of Patent: *Jun. 24, 2025**

(54) REFRIGERATOR DOOR WITH REPLACEABLE DOOR PANEL

(71) Applicants: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

(72) Inventors: Xiaofeng Li, Qingdao (CN); Wenchun Wang, Qingdao (CN); Hao Zhang, Qingdao (CN); Xuan Ji, Qingdao (CN); Jiaming Li, Qingdao (CN)

(73) Assignees: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 133 days.

This patent is subject to a terminal disclaimer.

(21) Appl. No.: 18/012,971

(22) PCT Filed: Jun. 18, 2021

(86) PCT No.: PCT/CN2021/100875

§ 371 (c)(1),
(2) Date: Dec. 26, 2022

(87) PCT Pub. No.: WO2022/001693

PCT Pub. Date: Jan. 6, 2022

(65) Prior Publication Data

US 2023/0251020 A1 Aug. 10, 2023

(30) Foreign Application Priority Data

Jun. 30, 2020 (CN) ..... 202010621496.X

(51) Int. Cl.
*F25D 23/02* (2006.01)
*A47B 96/20* (2006.01)

(52) U.S. Cl.
CPC ..... *F25D 23/028* (2013.01); *A47B 96/20* (2013.01); *A47B 2096/208* (2013.01); *A47B 2096/209* (2013.01)

(58) Field of Classification Search
CPC ... F25D 2400/18; A47B 2096/207–209; A47F 3/0426–0434
See application file for complete search history.

(56) References Cited

U.S. PATENT DOCUMENTS 7,770,985 B2 * 8/2010 Davis ..... E06B 3/7001 312/328
8,485,615 B2 * 7/2013 Ciyanoglu ..... F25D 23/10 312/204

(Continued)

FOREIGN PATENT DOCUMENTS

CN 2768625 Y 4/2006
CN 101231101 A 7/2008

(Continued)

*Primary Examiner* — Daniel P Cahn
*Assistant Examiner* — Patrick B. Ponciano
(74) *Attorney, Agent, or Firm* — Cheng-Ju Chiang

(57) ABSTRACT

The present invention provides a refrigerator door with a replaceable door panel, comprising: a foam door body, and a door panel detachably connected with the foam door body; the foam door body comprises: a foam main body, and a hook-catching portion embedded from a front surface of the foam main body; the door panel comprises a door panel face and a hook disposed in engagement with the hook-catching portion; the hook-catching portion comprises a first groove (Continued)

formed by recessing from the front surface of the foam main body towards an interior of the foam main body, where a first sliding groove disposed inclinedly and a second sliding groove connected to the first sliding groove are formed in the first groove; the hook comprises: a first sliding rod and a second sliding rod that engage the first sliding groove and the second sliding groove, respectively.

9 Claims, 11 Drawing Sheets

(56) References Cited

U.S. PATENT DOCUMENTS

| | | | | |
|---|---|---|---|---|
| 8,789,900 | B2 * | 7/2014 | Laible | A47B 96/20 312/204 |
| 11,320,192 | B2 * | 5/2022 | Lee | E06B 3/4627 |
| 11,774,164 | B2 * | 10/2023 | Moon | F25D 23/063 312/116 |
| 11,988,438 | B2 * | 5/2024 | Wang | F25D 23/02 |
| 2003/0067254 | A1 * | 4/2003 | Manke | A47L 15/4265 312/265.6 |
| 2012/0073202 | A1 * | 3/2012 | Lee | F25D 29/005 49/70 |
| 2020/0326119 | A1 * | 10/2020 | Lee | F25D 23/028 |
| 2023/0012438 | A1 * | 1/2023 | Hong | F25D 23/028 |
| 2023/0375250 | A1 * | 11/2023 | Maluto | A47F 3/0434 |

FOREIGN PATENT DOCUMENTS

| | | | | | |
|---|---|---|---|---|---|
| CN | 102435039 | A | | 5/2012 | |
| CN | 202277065 | U | | 6/2012 | |
| CN | 203230301 | U | | 10/2013 | |
| CN | 203240852 | U | | 10/2013 | |
| CN | 204273791 | U | | 4/2015 | |
| CN | 105333679 | A | | 2/2016 | |
| CN | 105466111 | A | | 4/2016 | |
| CN | 205860639 | U | | 1/2017 | |
| DE | 102011005892 | A1 | | 9/2012 | |
| DE | 102023108807 | A1 | * | 10/2024 | |
| EP | 0647821 | A1 | * | 10/1994 | |
| EP | 0718459 | A2 | * | 10/1995 | |
| EP | 3916323 | A4 | * | 12/2021 | A47B 96/20 |
| KR | 2003-0065973 | A | | 8/2003 | |
| KR | 10-2020-0045751 | A | | 5/2020 | |
| KR | 20210156166 | A | * | 6/2020 | |
| WO | WO-2008135431 | A1 | * | 11/2008 | F25D 23/028 |

* cited by examiner

REFRIGERATOR DOOR WITH REPLACEABLE DOOR PANEL

CROSS REFERENCE TO RELATED APPLICATIONS

The present application is a 35 U.S.C. § 371 National Phase conversion of International (PCT) Patent Application No. PCT/CN2021/100875, filed on Jun. 18, 2021, which claims the priority of Chinese Application No. 202010621496.X filed on Jun. 30, 2020, the disclosure of which is incorporated by reference herein. The PCT International Patent Application was filed and published in Chinese.

TECHNICAL FIELD

The present invention relates to the technical field of household appliances, and particularly to a refrigerator door with a replaceable door panel.

BACKGROUND

Along with constant development of science and technology, a refrigerator has already become one of indispensable household appliances. In current application, as the user's demands increase, the refrigerator is also required to exist as a decoration in the household environment in addition to as a household appliance; before buying the refrigerator, the user usually has many requirements for the refrigerator such as color and pattern, and a single appearance of the refrigerator affects the user's buying demands. In addition, since a service life of the refrigerator can usually be in a range of 8 years to 10 years, during use of the refrigerator by the user, the appearance of the refrigerator once bought cannot satisfy the user's demands for long-term adjustment as the environment and scenario change; in another case, the door panel also has a risk of being broken during use and transportation of the refrigerator; in the above cases, if the whole door body of the refrigerator is replaced, the replacement cost is high and the use of the refrigerator is also affected, which is not conducive in satisfying the consumer's demands.

In the conventional refrigerator door with a replaceable door panel in the prior art, hook holes are usually provided at a top end of the foamed door body, and hooks are provided at a top end of the door panel. During mutual combination of the door panel and the foamed door body, the hook holes are directly caught by the hooks to complete the replacement of the door panel of the refrigerator; in this way, upon completion of the assembling of the refrigerator door, the hooks usually protrude from the top end of the refrigerator, and the appearance is unlikely to satisfy the user's demands.

SUMMARY

An object of the present invention is to provide a refrigerator door with a replaceable door panel.

In order to achieve the above object, the refrigerator door with a replaceable door panel of the present invention comprising: a foam door body, and a door panel matching the foam door body and detachably connected with the foam door body; the foam door body comprises: a foam main body, and a hook-catching portion embedded from a front surface of the foam main body; the door panel comprises a door panel face and a hook disposed on a rear surface of the door panel and disposed in engagement with the hook-catching portion;

wherein the hook-catching portion comprises a first groove formed by recessing from the front surface of the foam main body towards an interior of the foam main body, and the first groove provides a first surface disposed close to an upper end of the foam main body, a second surface connected to the first surface and disposed close to the foam main body, and a third surface and a fourth surface connected to the first surface and second surface, respectively;

the first surface is an inclined surface disposed inclined from down to up and towards outside the first groove;

the hook-catching portion further comprises: a first inclined surface spaced apart from at least one of the third surface and the fourth surface and protruding from the second surface towards the first surface, where the first surface and the first inclined surface are parallel to each other, a first sliding groove is formed between parallel portions thereof, and an entrance to the first sliding groove is formed between ends of first surface and the first inclined surface facing towards the front surface of the foam main body; a second sliding groove and/or a third sliding groove are/or formed between sidewalls of the first inclined surface and the third surface and/or the fourth surface spaced apart from the first inclined surface;

the hook comprises: a first sliding rod disposed in parallel with the door panel, and at least one second sliding rod connecting the first sliding rod with the door panel;

the first sliding rod is matchingly disposed in the first sliding groove, and spaced apart from the entrance to the first sliding groove; the second sliding rod is matchingly disposed in the preset second sliding groove and/or the third sliding groove.

As a further improvement of an embodiment of the present invention, wherein a portion recessed to form the first groove is in a shape of a right-angle triangular boss, one of right-angle surfaces of the right-angle triangular boss is coplanar with the front surface of the foam main body, and wherein the other right-angle surface, the inclined surface and two symmetrical end faces of the right-angle triangular boss form the second surface, the third surface and the fourth surface of the first groove, respectively.

As a further improvement of an embodiment of the present invention, wherein a circular arc surface is disposed at a position where the first surface and the second surface are connected.

As a further improvement of an embodiment of the present invention, wherein a stopper is disposed extending from the second surface toward the first surface, and the stopper has a wall surface which is near the first surface and forms the first inclined surface; the stopper further comprises: a second connecting surface disposed close to and parallel to the second surface and/or a third connecting surface disposed close to and parallel to the third surface, and a fourth connecting surface simultaneously connected to the first inclined surface and the second surface.

As a further improvement of an embodiment of the present invention, wherein the fourth connecting surface extends from the end of the second surface away from the first sliding groove towards the first inclined surface.

As a further improvement of an embodiment of the present invention, wherein the fourth connecting surface comprises a first sub-connecting surface perpendicular to the second surface, and a second sub-connecting surface connecting the first sub-connecting surface with the first inclined surface, the second sub-connecting surface being an inclined surface disposed from down to up and inclined inward the first groove.

As a further improvement of an embodiment of the present invention, wherein a circular arc surface is provided at a position where the first sub-connecting surface and the second sub-connecting surface are connected, and/or a circular arc surface is provided at a position where the second sub-connecting surface and the first inclined surface are connected.

As a further improvement of an embodiment of the present invention, wherein the stopper comprises the first inclined surface, the second connecting surface, the third connecting surface and the fourth connecting surface;

the hook comprises: a first sliding rod disposed in parallel with the door panel, and two second sliding rod connecting the door panel with the first sliding rod, the two second sliding rods being parallel to each other.

As a further improvement of an embodiment of the present invention, wherein the second sliding rods are perpendicular to a rear wall surface of the door panel.

As a further improvement of an embodiment of the present invention, wherein the hook-catching portion further comprises a hook-catching sheet disposed on the front surface of the foam door body, a middle portion of the hook-catching sheet being recessed towards the interior of the foam door body to form the first groove;

a U-shaped boss is disposed on a wall surface of the hook-catching sheet facing towards the door panel and below the first groove, a U-shaped opening of the boss faces towards the top of the foam door body, and a U-shaped first positioning groove is formed on the wall surface of the hook-catching sheet facing towards the door panel;

the hook further comprises a fixing plate disposed on the rear surface of the door panel, a raised sheet protrudes in the middle of the fixing plate towards the foam door body, and the second sliding rods are disposed on the raised sheet;

a second positioning groove is formed by inwardly recessing from the surface of the raised sheet facing towards the foam door body, below each first sliding rod and at a position corresponding to the first sliding rod, and the second positioning groove runs through the wall surface of the raised surface facing towards the foam door body;

the refrigerator door further comprises a magnetic attraction sheet and an iron sheet which cooperate with each other in a magnetically-attractive manner;

one of the magnetic attraction sheet and iron sheet is disposed at a position on a wall surface of the hook-catching sheet in the interior of the foam door body, at a position corresponding to the first positioning groove, and the other of the magnetic attraction sheet and iron sheet is disposed protrudingly from a bottom surface of the second positioning groove towards outward the second positioning groove with a protrusion height not greater than a depth of the second positioning groove;

upon completion of the mounting of the refrigerator door, the magnetic attraction sheet or the iron sheet disposed in the second positioning groove is at least partially embedded in the first positioning groove.

Advantageous effects of the present invention are as follows: according to the refrigerator door with the replaceable door panel in the present invention, with the hook-catching portion and the hook that engage each other being disposed on the foam door body and the door panel, the mounting of the door panel to the foam door body or detachment of the door panel from the foam door body becomes simple and reliable, the overall structure is simple, the replacement process is time-saving and labor-saving, and the replacement cost is saved.

DETAILED DESCRIPTION

Figure 1:
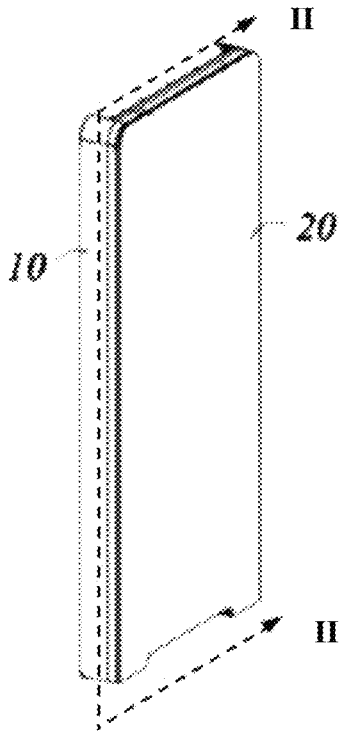
FIG. 1 is an overall structural schematic view of a refrigerator door with a replaceable door panel according to a first embodiment of the present invention.
Figure 2:
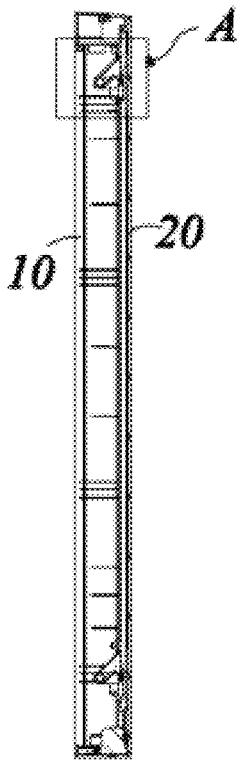
FIG. 2 is a cross-sectional view taken along direction II-II in FIG. 1.
Figure 3:
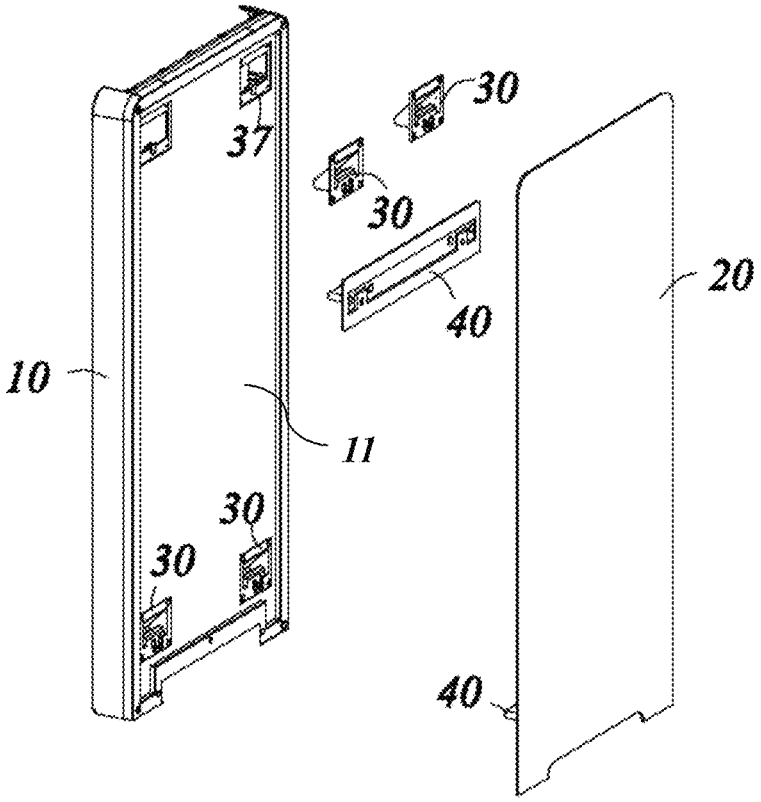
FIG. 3 is an exploded view of FIG. 1.

The present invention will be described in detail below in combination with embodiments shown in the figures. However, these embodiments do not limit the present invention, and structural or functional changes made by those having ordinary skill in the art according to these embodiments are all included in the protection scope of the present invention.

Compartments of the refrigerator vary with designed structures and/or functions of the refrigerator. In the prior art, the refrigerator usually comprises a plurality of compartments such as a refrigerating compartment, a freezing compartment, a soft freezing compartment etc. One door body or two door bodies are usually disposed corresponding to each compartment of the refrigerator. Correspondingly, the number of the compartments and the number of refrigerator doors corresponding to the compartments may also be specifically adjusted according to needs. In the following specific examples of the present invention, the refrigerator comprises two refrigerator doors, namely, an upper refrigerator door and a lower refrigerator door.

As shown in FIG. 1 through FIG. 6, a refrigerator door with a replaceable door panel according to a first embodiment of the present invention is provided. In this example, an upper refrigerator door is taken as an example of the refrigerator door and specifically introduced. In this specific example, the refrigerator door comprises: a foam door body 10, a door panel 20 matching the foam door body 10 and detachably connected with the foam door body 10; the foam door body 10 comprises: a foam main body 11, and a hook-catching portion 30 embedded from a front surface of the foam main body 11; the door panel 20 comprises a door panel face and a hook 40 disposed on a rear surface of the door panel and disposed in engagement with the hook-catching portion 30.

Figure 4:
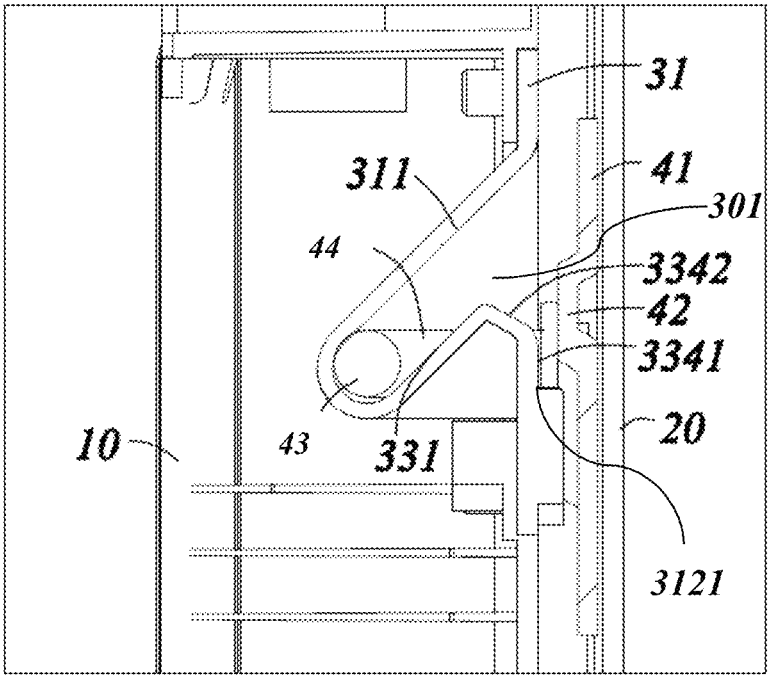
FIG. 4 is an enlarged view of a portion shown in quadrilateral A in FIG. 2.
Figure 5:
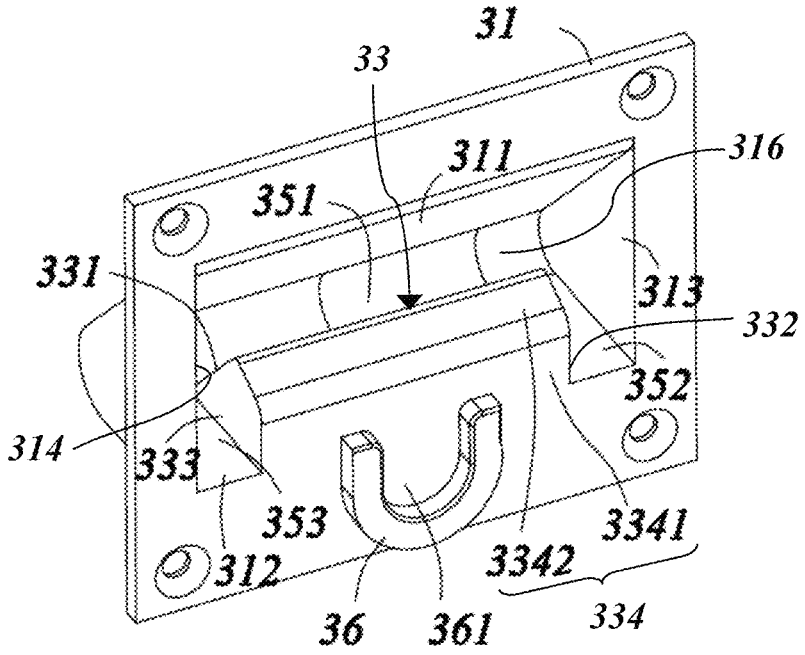
FIG. 5 is a view of a hook-catching portion in FIG. 3.

In a specific embodiment of in the present invention, referring to FIG. 4 and FIG. 5, the hook-catching portion 30 comprises a first groove 301 formed by recessing from the front surface of the foam main body 11 towards an interior of the foam main body 11. The first groove 301 has a first surface 311 disposed close to an upper end of the foam main body 11, a second surface 312 connected to the first surface 311 and disposed close to a lower end of the foam main body 11, and a third surface 313 and a fourth surface 314 connected to the first surface 311 and second surface 312, respectively; the first surface 311 is an inclined surface disposed inclined from down to up and towards outside the first groove 301; the hook-catching portion 30 further comprises: a first inclined surface 331 spaced apart from at least one of the third surface 313 and the fourth surface and protruding from the second surface 312 towards the first surface 311; the first surface 311 and the first inclined surface 331 are parallel to each other, a first sliding groove 351 is formed between parallel portions thereof, and an entrance to the first sliding groove 351 is formed between ends of first surface 311 and the first inclined surface 331 facing towards the front surface of the foam main body 11; a second sliding groove 352 and/or a third sliding groove 353 are/is formed between sidewalls of the first inclined surface 331 and the third surface 313 and/or the fourth surface spaced apart from the first inclined surface 331.

In a preferred embodiment of in the present invention, the hook-catching portion further comprises a hook-catching sheet 31 disposed on the front surface of the foam door body 10, a middle portion of the hook-catching sheet 31 being recessed towards the interior of the foam door body 10 to form the first groove 301.

In a preferred embodiment of in the present invention, a circular arc surface 316 is disposed at a position where the first surface 311 and the second surface 312 are connected, thereby enabling a sliding bar of a hook 40 to be embedded at a bottom of the first sliding groove 351 more tightly.

In a preferred embodiment of in the present invention, the first inclined surface 331 is a portion of a stopper 33 protruding from the second surface 312; Specifically, a stopper 33 is disposed extending from the second surface 312 toward the first surface 311, and the stopper 33 has a wall surface which is near the first surface 311 and forms the first inclined surface 331; the stopper 33 further comprises: a second connecting surface 333 disposed to face the fourth surface 314, a third connecting surface 332 disposed close to and parallel to the third surface 313, and a fourth connecting surface 334 simultaneously connected to the first inclined surface 331 and the second surface 312.

In a specific example of in the present invention, a portion recessed to form the first groove 301 is in a shape of a right-angle triangular boss. One of right-angle surfaces of the right-angle triangular boss is coplanar with the front surface of the foam main body 11, and the other right-angle surface, the inclined surface and two symmetrical end faces of the right-angle triangular boss form the second surface 312, the third surface 313 and the fourth surface of the first groove 301, respectively.

Preferably, the stopper 33 comprises the first inclined surface 331, the second connecting surface, the third connecting surface 332 and the fourth connecting surface 334; Correspondingly, the first sliding groove 351 is formed between the first inclined surface 331 and the first surface 311, the second sliding groove 352 is formed between the second connecting surface and the third surface 313, and the third sliding groove 353 is formed between the third connecting surface 332 and the fourth surface 314.

In a preferred embodiment of in the present invention, the fourth connecting surface 334 extends from the end 3121 of the second surface 312 away from the first sliding groove 351 towards the first inclined surface 331, so that the door panel 20 may be detachably connected with the foam door body 10.

In a specific example of in the present invention, the fourth connecting surface 334 comprises a first sub-connecting surface 3341 perpendicular to the second surface 312, and a second sub-connecting surface 3342 connecting the first sub-connecting surface 3341 with the first inclined surface 331, the second sub-connecting surface 3342 being an inclined surface disposed from down to up and inclined inward the first groove 301; while the door panel 20 is assembled to the foam door body 10, the sliding bar may move upward towards the entrance of the first sliding groove 351 by virtue of a slope of the second sub-connecting surface 3342, and then slides downward from the entrance to the first sliding groove 351 into the first sliding groove 351.

In a preferred embodiment of in the present invention, a circular arc surface is provided at a position where the first sub-connecting surface 3341 and the second sub-connecting surface 3342 are connected, and/or a circular arc surface is provided at a position where the second sub-connecting surface 3342 and the first inclined surface 331 are connected, thereby helping the door panel 20 to be mounted to or detached from the foam door body 10.

Preferably, an angle between the first surface 311 and the front surface of the foam door body 10 is preferably less than or equal to 45 degrees, thereby preventing the door panel 20 from accidentally sliding out of the foam door body 10; an angle between the second sub-connecting surface 3342 and the front surface of the foam door body 10 is preferably in a range between 45 degrees and 90 degrees, thereby facilitating the door panel 20 to be cooperatively mounted on the foam door body 10.

Figure 6:
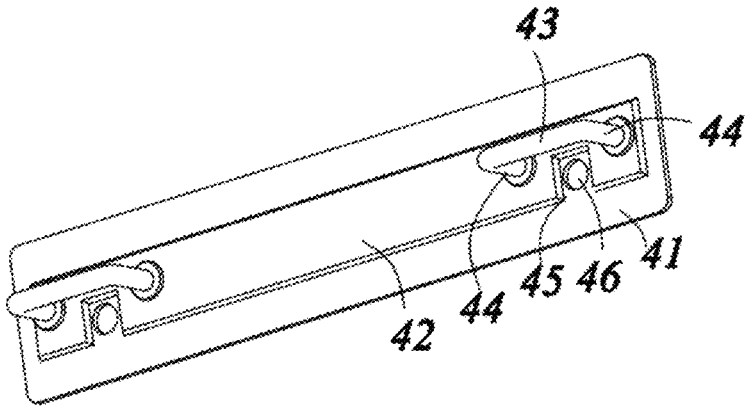
FIG. 6 is a view of a handle in FIG. 2.
Figure 7:
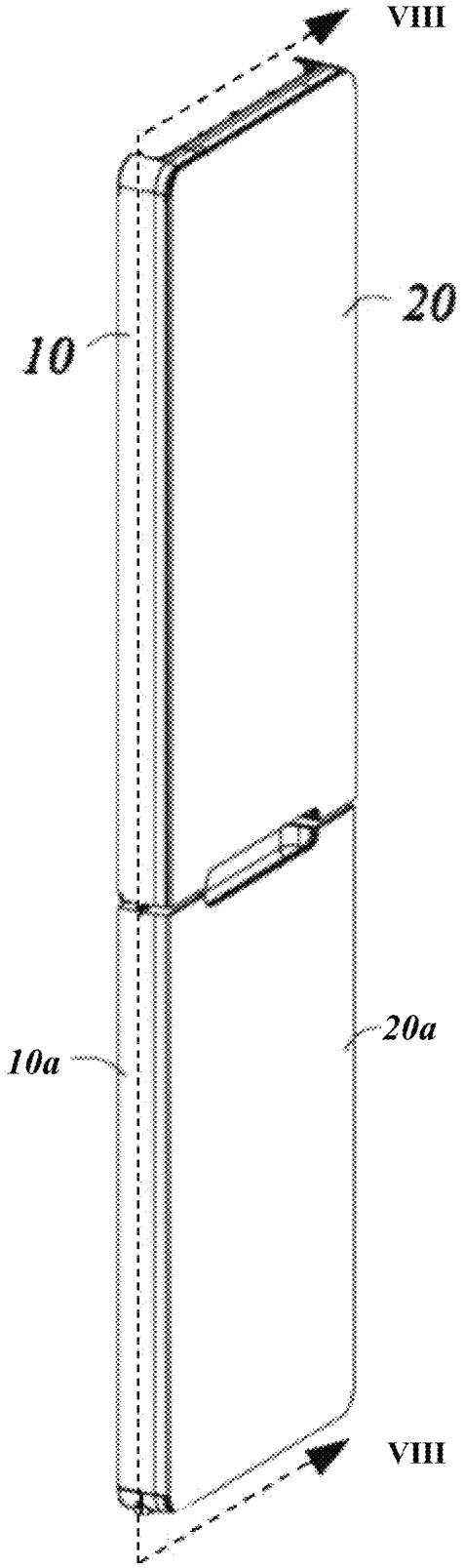
FIG. 7 is an overall structural schematic view of a refrigerator door with a replaceable door panel according to a combination of a second embodiment and a third embodiment of the present invention.
Figure 8:
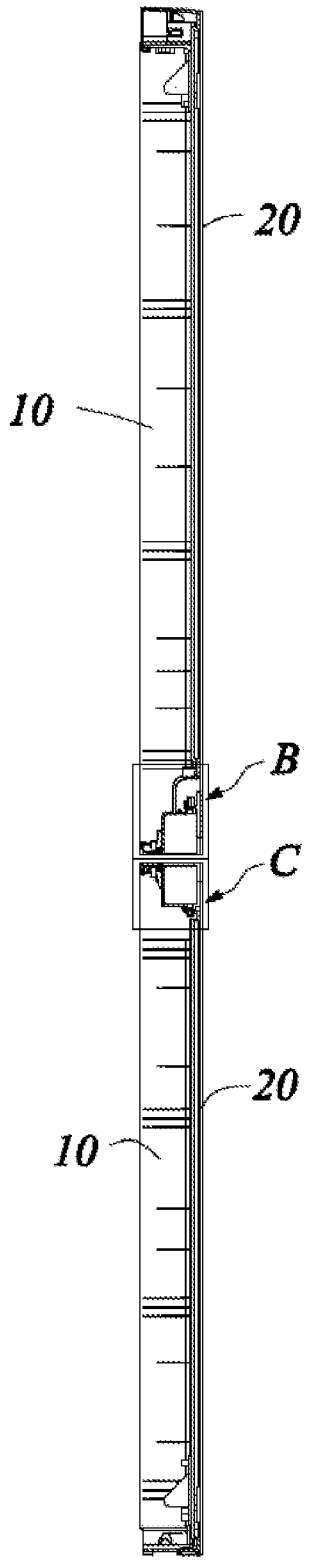
FIG. 8 is a cross-sectional view taken along direction VIII-VIII in FIG. 7.
Figure 9:
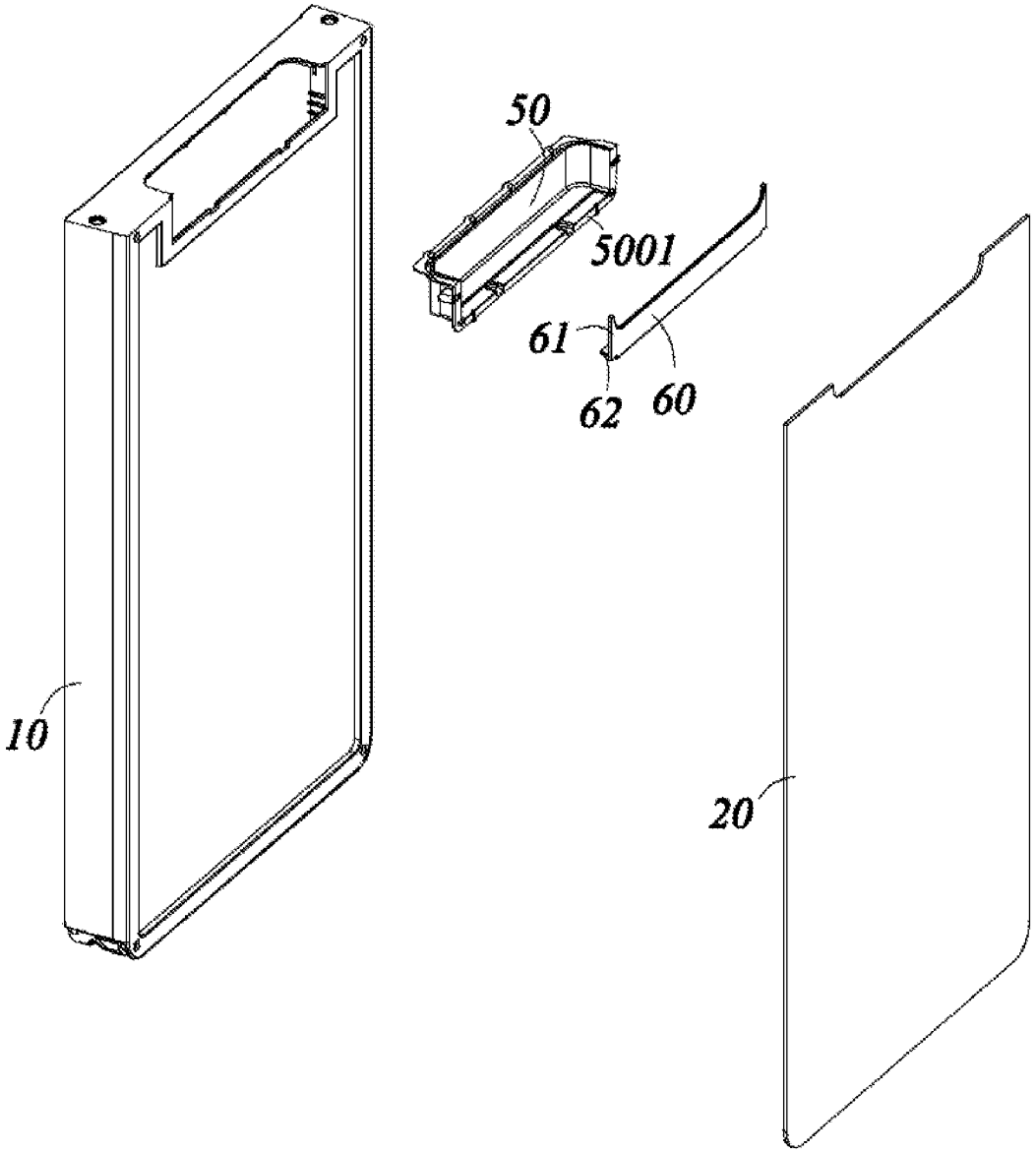
FIG. 9 is an exploded view of a lower refrigerator door according to a second embodiment of the present invention.
Figure 10:
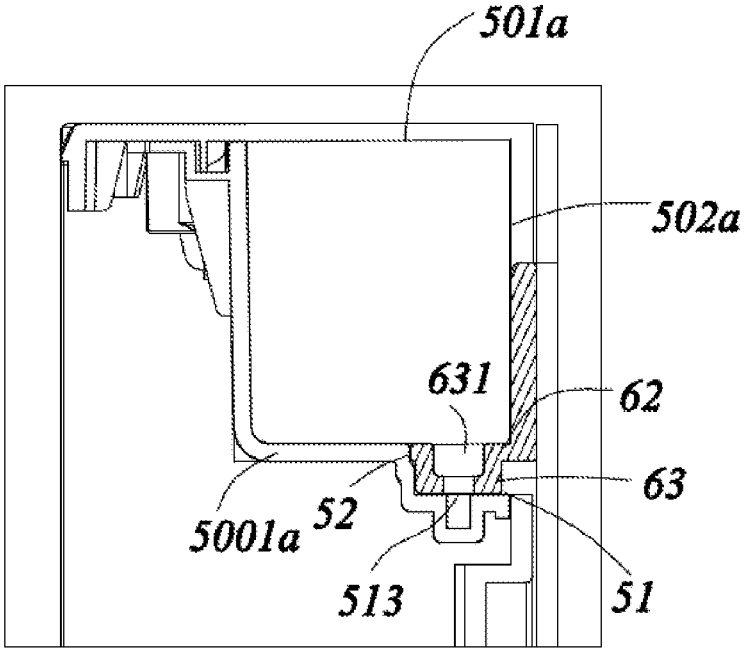
FIG. 10 is an enlarged view of a portion shown in quadrilateral B in FIG. 8.
Figure 11:
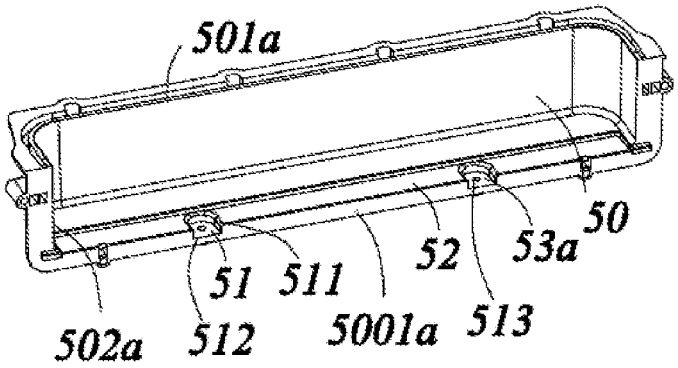
FIG. 11 is a view of a handle groove in FIG. 9.
Figure 12:
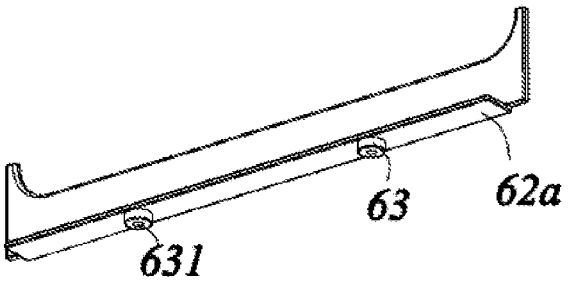
FIG. 12 is a view of a cover plate in FIG. 9.
Figure 13:
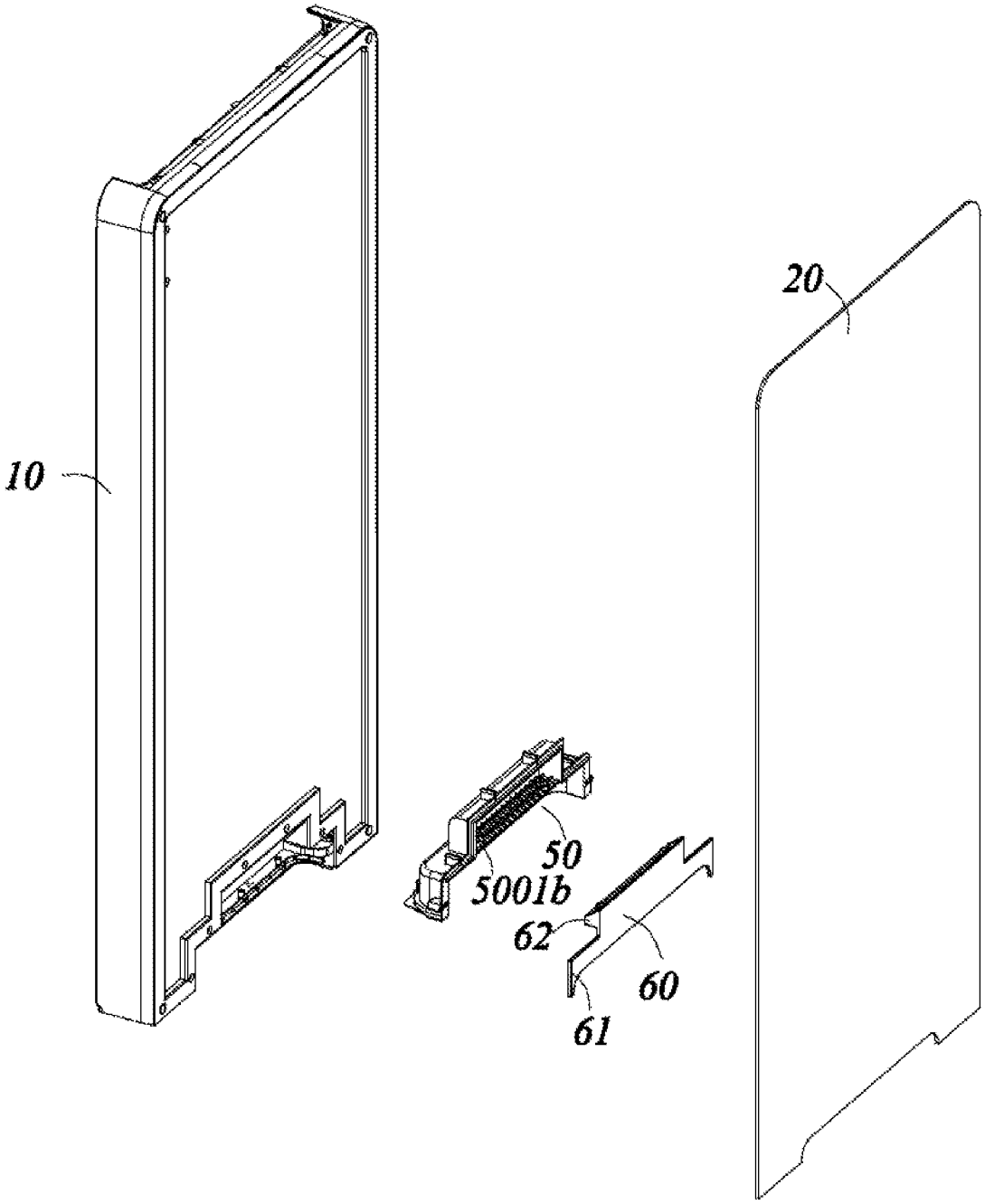
FIG. 13 is an exploded view of an upper refrigerator door according to a third embodiment of the present invention.
Figure 14:
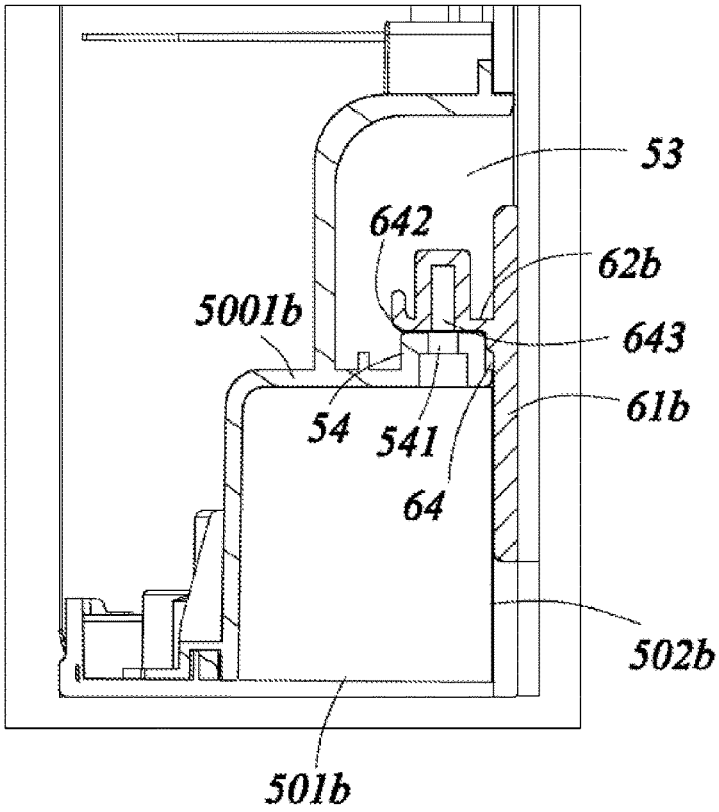
FIG. 14 is an enlarged view of a portion shown in quadrilateral C in FIG. 8.
Figure 15:
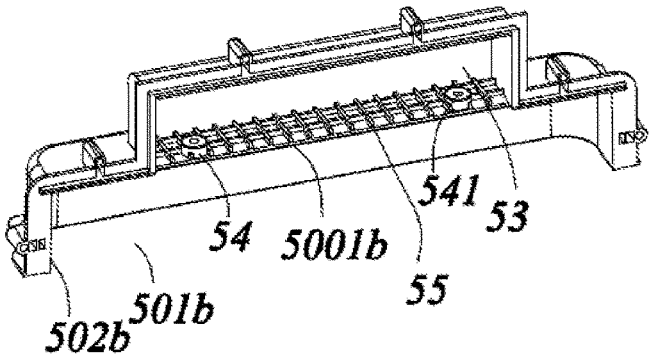
FIG. 15 is a view of a handle groove in FIG. 13.
Figure 16:
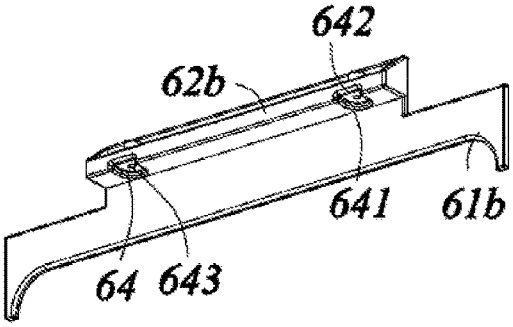
FIG. 16 is a view of a baffle in FIG. 13.

As shown in FIG. 4 and FIG. 6, the hook 40 comprises: a first sliding rod 43 disposed in parallel with the door panel 20, and at least one second sliding rod 44 connecting the first sliding rod 43 with the door panel 20; the first sliding rod 43 is matchingly disposed in the first sliding groove 351, and spaced apart from the entrance of the first sliding groove 351; the second sliding rod 44 is matchingly disposed in the preset second sliding groove 352 and/or the third sliding groove 353.

It needs to be appreciated that the second sliding rod 44 mainly aims to connect the first sliding rod 43 with the door panel 20, the number of the second sliding rod 44 may be changed according to the number of sliding grooves formed in the hook-catching portion 30, and the number of the second sliding rod 44 is at least one and at most a number obtained by subtracting the total number of the sliding grooves by one; for example, in the example shown in FIG. 5, when the sliding grooves formed in the hook-catching portion 30 are respectively the first sliding groove 351, the second sliding groove 352 and the third sliding groove 353, that is, the number of sliding grooves is three; at this time, the number of the second sliding rods 44 may be set to one or two.

In a specific example of in the present invention, the hook 40 comprises a first sliding rod 43 disposed in parallel with the door panel 20, and two second sliding rods 44 respectively connecting the door panel 20 and both ends of the first sliding rod 43, the two second sliding rods 44 being parallel to each other.

Preferably, the second sliding rods 44 are perpendicular to a rear wall surface of the door panel 20.

In a preferred embodiment of the present invention, the hook further comprises a fixing plate 41 disposed on the rear surface of the door panel 20, a raised sheet 42 protrudes in the middle of the fixing plate 41 towards the foam door body 10, and the second sliding rods 44 are disposed on the raised sheet 42.

The door panel 20 may be made of a glass material or other metal materials.

As shown in FIG. 3 through FIG. 6, in a preferred embodiment of the present invention, position-limiting magnetic attraction devices that cooperate with one another are also disposed between the foam door body 10 and the door panel 20, so that the relative positions of the door panel 20 and the foam door body 10 are fixed in both mechanical and magnetically-attractive ways during the mounting.

In a specific embodiment of in the present invention, the refrigerator door further comprises a magnetic attraction sheet and an iron sheet which cooperate with each other in a magnetically-attractive manner; a U-shaped boss 36 is disposed on a wall surface of the hook-catching sheet facing towards the door panel 20 and below the first groove 301, a U-shaped opening of the boss 26 faces towards the top of the foam door body 10, and a U-shaped first positioning groove 361 is formed on the wall surface of the hook-catching sheet 31 facing towards the door panel 20; an second positioning groove 45 is formed by inwardly recessing from the surface of the raised sheet 42 facing towards the foam door body 10, below each first sliding rod 43 and at a position corresponding to the first sliding rod 43, and the second positioning groove 45 runs through the wall surface of the raised surface 42 facing towards the lower end of the foam door body 10.

One of the magnetic attraction sheet 37 and iron sheet 46 is disposed at a position on a wall surface of the hook-catching sheet 31 in the interior of the foam door body, at a position corresponding to the first positioning groove 361, and the other of the magnetic attraction sheet 37 and iron sheet 46 is disposed protrudingly from a bottom surface of the second positioning groove 45 towards outward the second positioning groove 45 with a protrusion height not greater than a depth of the second positioning groove 45; upon completion of the mounting of the refrigerator door, the magnetic attraction sheet 37 or the iron sheet 46 disposed in the second positioning groove 45 is at least partially embedded in the first positioning groove 361. As such, the mutual attraction of the magnetic attraction sheet 37 and iron sheet 46 may reduce the sliding of the door panel 20 relative to the foam door body 10, and reduce the possibility of the relative movement of the hook 40 in the hook-catching portion 30 caused by accidental collision of the door panel 20; meanwhile, the U-shaped first positioning groove 361 fixes the position of the magnetic attraction sheet 37 and iron sheet 46 embedded therein, and indirectly and precisely fixes the relative positions of the door panel 20 and the foam door body 10 in the horizontal direction.

In a preferred embodiment of in the present invention, the magnetic attraction sheet 37 is disposed in the foam door body 10, and the iron sheet 46 is disposed on the door panel 20; specifically, a groove is disposed in the rear wall surface of the foam door body corresponding to the hook-catching sheet 31, and the hook-catching sheet is embedded in the groove. During the fabrication of the foam door body, the magnetic attraction sheet 37 is built in the groove first, and then the hook-catching sheet 31 is embedded in the foam door body through a notch on the foam door body. The hook-catching sheet 31 may be connected to the foam door body in many ways, for example, they are fixed by snap-fitting, an adhesive, a bolt or the like, which will not be detailed any more here.

In a specific embodiment of in the present invention, the hook-catching portions 30 match one to one with the hooks 40; the number of the hook-catching portions 30 may be specifically set as needed; preferably, the hook-catching portions 30 are set in an even number, and are all arranged close to the upper and lower ends of the foam door body 10; furthermore, when the extension length of the hook-catching portion 30 in the horizontal direction is small, multiple sets of hook-catching portions may be arranged in the horizontal direction, so that the weight of the door panel 20 when hung on the foam door body 10 may be shared by the multiple sets of hook-catching portions 30; correspondingly, when the extension length of the hook-catching portion 30 in the horizontal direction is large, one set of hook-catching portion 30 may be arranged at a middle position in the horizontal direction at one end of the foam door body 10; certainly, it is also possible to arrange the multiple hook-catching portions 30 in a shape of a matrix, a polygon and or a curve on the whole, which will not be detailed any more here. In a specific embodiment of the present invention, the hook-catching portions 30 comprises four sets of hook-catching portions 30 with every two sets being arranged symmetrically, and the four sets of hook-catching portions 30 are arranged near four corners of the foam door body 10.

In the installation process of the refrigerator door with the replaceable door panel according to the first embodiment above, the foam door body 1010 is usually foamed before leaving the factory, and the hook-catching sheets are fixed on the front wall surface of the foam door body 10 before or after the foaming; in addition, the fixing plate is fixed on the rear wall surface of the door panel 20 by applying an adhesive, and the hooks 40 are mounted on the fixing plates before or after the fixing plates engage the door panel 20. The hooks 40 may be connected to the fixing plates by fitting with screws, by applying an adhesive, by integral forming or the like, thereby preparing for detachably mounting the door panel 20 to the foam door body 10. When the door panel 20 is replaced, the rear wall surface of the door panel 20 and the front wall surface of the foam door body 10 are placed opposite in the same plane, whereupon the first sliding rod 43 is disposed opposite to the first sub-connecting surface 3341; furthermore, the door panel 20 is lifted, the first sliding rod 43 slides towards the entrance of the first sliding groove 351 along the slope of the second sub-connecting surface 3342; when the first sliding rod 43 enters the entrance of the first sliding groove 351, the door panel 20 is pressed down, the first sliding rod 43 enters the first sliding groove 351 along the entrance of the first sliding groove 351, and stays stationary when the first sliding rod 43 slides to the bottom end of the first sliding groove 351; in this process, two second sliding rods 44 correspondingly enter the second sliding groove 352 and third sliding groove 353 and correspondingly stay at the bottom portions of the corresponding sliding grooves; the iron sheet 46 and the magnetic attraction sheet 37 attract each other, and the iron sheet 46 is embedded in the first positioning groove, and the mutual magnetic attraction action of the iron sheet 46 and the magnetic attraction sheet 37 is the most powerful; at this time, the front panel is fixed on the foam door body 10 through the interaction of multiple structures. When the door panel is detached, the detaching process is contrary to the above process. It needs to be appreciated that in this example, in the detaching process, the door panel 20 is lifted, whereupon a force lifting the door panel 20 is converted into an outward force under the action of the slope of the first sliding groove 351, thereby causing the door panel 20 to disengage from the foam door body 10, which will not be detailed any more here.

According to the refrigerator door with the replaceable door panel in the first embodiment, during the fitting and mounting of the door panel 20 and the foam door body 10, by providing the first inclined surface 331 on the stopper, the first sliding rod 43 is locked in the first sliding groove 351; meanwhile, the front panel is fixed on the foam door body 10 through the position-limiting magnetic attraction devices between the door panel 20 and the foam door body 10 and through the interaction of multiple structures; in the detaching process, the door panel 20 can be easily disengaged from the foam door body 10 by lifting up the door panel 20 along the first inclined surface 331, so that the replacement of the door panel 20 becomes simple and reliable, the overall structure is simple, the replacement process is time-saving and labor-saving, and the replacement cost is saved.

Referring to FIGS. 7, 8, 9 and 13, the refrigerator doors with the replaceable door panel in a second embodiment and a third embodiment of the present invention both comprise: a foam door body 10, a door panel 20, and a hidden handle formed at an interface of the foam door body 10 and the door panel 20 and disposed near their edges; the foam door body 10 and the door panel 20 are detachably connected through the hidden handle; the hidden handle comprises: a handle groove 50 formed by inwardly recessing from the sidewall of the foam door body towards the interior of the foam door body 10, the handle groove 50 having a first opening formed on a sidewall surface of the foam door body 10, the front wall surface of the foam door body 10 corresponding to the handle groove 50 being further provided with a second opening running through the handle groove 50, the first opening being communicated with the second opening; the hidden handle further comprises a cover plate 60 disposed on a rear wall surface of the door panel 20 and at least sealing part of the second opening; the cover plate 60 comprises: a first baffle 61 disposed in cooperation with the door panel and a second baffle 62 extending from the first baffle 61 towards the handle groove 50; the second baffle 62 is snap-fitted with a bottom wall 5001 of the handle groove 50 to achieve the detachable connection of the foam door body 10 and the door panel 20.

In an embodiment of the present invention, the first opening is formed on a wall surface where the top end of the foam door body 10 is located or a wall surface where the bottom end of the foam door body 10 is located; the second baffle 62 is disposed exactly above a bottom wall 5001 of the handle groove. In this way, the foam door body 10 can bear the door panel 20 through the snap-fitting of the hidden handle.

A first boss and/or a first receiving groove are/or disposed on the bottom wall 5001 of the handle groove, and a second receiving groove matching the first boss and/or a second boss matching the first receiving groove are/or disposed on the second baffle 62; the handle groove 50 may be better snap-fitted with the cover plate 60 through this structure, and the cover plate 60 may be prevented from moving in the horizontal direction relative to the handle groove 50 through this structure.

In a preferred embodiment of the present invention, a first threaded hole and a second threaded hole are respectively disposed at opposite positions of the first boss and the second receiving groove, and/or a third threaded hole and a fourth threaded hole are respectively disposed at opposite positions of the second boss and the first receiving groove; the handle groove 50 further comprises: bolts (not shown) which are mated with the first threaded hole and the second threaded hole, and/or mated with the third threaded hole and the fourth threaded hole; through this structure, the relative positions of the handle groove 50 and the cover plate 60 may be further locked, and thereby the position of the door panel 20 relative to the foam door body 10 may be further locked, so that the door panel 20 may be kept in a relatively fastened state in any direction.

Certainly, in other embodiments of the present invention, the mating and fixing structure of the bolt and threaded hole may also be provided at other positions, for example, a position of a trim strip on the foam door body 10. The mating manner of the bolt and the threaded hole may limit the freedom of the relative movement between the door panel 20 and the foam door body 10 in any direction, and is structurally simple and reliable and convenient for the transportation of the refrigerator, which will not be further detailed any more here.

In addition, it needs to be appreciated that in a preferred embodiment of the present invention, the handle groove may be formed by directly recessing on the foam door body, or the handle groove may be integrally fabricated as one component. During the manufacturing process of the foam door body, the finished handle groove is embedded in a corresponding position of the foam door body according to a position relationship between the handle groove and the foam door body. The cover plate may usually be fixed on the front panel for example by applying an adhesive, which will not be further detailed any more here.

In the following specific embodiments, for ease of description, parts with the same technical terms in the refrigerator door with the replaceable door panel provided by the second embodiment and the third embodiment of the present invention will be denoted by respectively adding the suffixes a and b after the corresponding reference numbers in the first embodiment.

As shown in FIG. 7 through FIG. 12, in the refrigerator door with a replaceable door panel provided by the second embodiment of the present invention, the first opening 501*a* is formed on a wall surface where the top end of the foam door body 10 is located, an end which is of the bottom wall 5001*a* of the handle groove and adjacent to the second opening 502*a* is recessed downward to form a third receiving groove 52, and a bottom wall of the third receiving groove 52 is recessed downward to form a first receiving groove 51; the first receiving groove 51 has a third opening 511 formed on a top wall of the third receiving groove 52, a sidewall which is of the first receiving groove 51 and shares the front wall surface of the foam door body 10 is provided with a fourth opening 512 running through the first receiving groove 51, and the third opening 511 is communicated with the fourth opening 512; a second boss 63 is disposed on a lower end face of the second baffle 62*a*; upon the completion of the assembling of the refrigerator door, the second boss 63 is embedded in the first receiving groove 51; the second baffle 62*a* is embedded in the third receiving groove 52, and an upper surface of the second baffle 62*a* smoothly transitions with the inner wall surface of the bottom wall 5001*a* of the handle groove.

Furthermore, a third threaded hole 631 and a fourth threaded hole 513 are respectively disposed at opposite positions of the second boss 63 and the first receiving groove 51; the handle groove 50 further comprises a bolt mated with the third threaded hole 631 and the fourth threaded hole 513.

Preferably, the third threaded hole 631 is through and extends to an upper end face of the second baffle 62*a*; during the assembling of the refrigerator door, the bolt (not shown) enters from the upper end face of the second baffle 62*a*, and runs through and is screwed tightly in the third threaded hole 631 and the fourth threaded hole 513 in turn; upon completion of the assembling of the refrigerator door, a cap of the bolt is embedded in the second baffle 62*a* to prevent the bolt from protruding from the upper end face of the second baffle 62*a*, thereby ensuring the safety of the user when using the hidden handle.

Preferably, an extension table corresponding to and covering the fourth threaded hole 513 is disposed on an outer wall surface of a bottom end wall of the first receiving groove 51. The fourth threaded hole 513 is disposed through the extension table, thereby extending the axial length of the fourth threaded hole 513 and increasing a load-bearing capacity of the fourth threaded hole 513.

Referring to FIG. 13 through FIG. 16, in the refrigerator door with the replaceable door panel provided by the third embodiment of the present invention, the first opening 501*b* is formed on the wall surface where the bottom end of the foam door body 10 is located, the front wall surface shared by the handle groove and the foam door body is further provided with a second opening 502*b* running through the handle groove, and the first opening 501*b* is communicated with the second opening 502*b*; the hidden handle further comprises: a fourth receiving groove 53 formed by inwardly recessing from the front wall surface of the foam door body 10 and configured to receive the second baffle 62*b*, a first side wall of the fourth receiving groove 53 sharing the bottom wall 5001*b* of the handle groove; the first boss 54 is disposed on the outer wall surface of the bottom wall 5001*b* of the handle groove.

A lower wall surface of the second baffle 62*b* is recessed upward to form the second receiving groove 64; the second receiving groove 64 has a fifth opening 641 formed on the lower wall surface of the second baffle 62*b*, a sixth opening 642 running through the second receiving groove 64 is provided on a sidewall shared by the second receiving groove 64 and an end face of the second baffle 64 away from the first baffle 61*b*, and the fifth opening 641 is communicated with the sixth opening 642; in this example, the fourth receiving groove 53 is disposed mainly to provide a receiving space for the second baffle 62*b*, thereby preventing the second baffle 62*b* from directly contacting the foam material in the foam door body 10.

Upon completion of the assembling of the refrigerator door, the first boss 54 is embedded in the second receiving groove 64; the second baffle 62*b* abuts against the outer wall surface of the bottom wall 5001*b* of the handle groove, the first baffle 61*b* completely closes the opening of the fourth receiving groove 53, and meanwhile the first baffle 61*b* abuts against and closes part of the opening of the handle groove.

Preferably, the first baffle 61*b* abuts against the end face of the first side wall at the same time, so that the cover plate is more stably fitted and connected with the handle groove.

Furthermore, a first threaded hole 541 and a second threaded hole 643 are respectively disposed at opposite positions of the first boss 54 and the second receiving groove 64; the handle groove 50 further comprises a bolt (not shown) mated with the first threaded hole 541 and the second threaded hole 643.

Preferably, the first threaded hole 541 is through and extends to an inner wall face of the bottom wall 5001*b* of the handle groove 50; during the assembling of the refrigerator door, the bolt enters from the inner wall surface of the bottom wall 5001*b* of the handle groove, and runs through and is screwed tightly in the first threaded hole 541 and the second threaded hole 643 in turn; upon completion of the assembling of the refrigerator door, a cap of the bolt is embedded in the bottom surface 5001*b* of the handle groove to prevent the bolt from protruding from the bottom wall 5001*b* of the handle groove 50 and being exposed in the handle groove 50, thereby ensuring the safety of the user when using the hidden handle.

Preferably, an extension table corresponding to and covering the second threaded hole 643 is disposed on an outer wall surface of a bottom end wall of the second receiving groove 64. The second threaded hole 643 is disposed through the extension table, thereby extending the axial length of the second threaded hole 643 and increasing a load-bearing capacity of the second threaded hole 643.

Preferably, on the inner wall surface of the first sidewall and covering the first boss 54, crisscross reinforcing ribs 55 are disposed on the inner wall surface of the first sidewall and cover the first boss 54, so that when the second baffle 62*b* abuts against the first sidewall, the fitting degree of the second baffle 62*b* and the first sidewall is enhanced.

There are two specific modes for implementing the refrigerator door with the replaceable door panel provided by the second embodiment and third embodiment of the present invention. During the assembling of the refrigerator door, the door panel 20 is pushed to push the second baffle 62 from the upper end of the bottom wall 5001 of the handle groove inward towards the foam door body 10, and the pushing of the door panel 20 is stopped when the boss and/or receiving groove on the door panel 20 completely mate with the receiving groove and/or boss on the bottom wall 5001 of the handle groove; at this time, the door panel 20 is relatively fixed on the foam door body 10; furthermore, with the bolts tightly mated with corresponding threaded holes, the door panel 20 may be firmly positioned on the foam door body 10, whereupon the door panel 20 does not disengage from the foam door body 10 in any direction upon receiving an external force.

According to the refrigerator door with the replaceable door panel provided by the second embodiment and third embodiment of the present invention, with the hidden handle being disposed at the interface of the foam door body 10 and the door panel 20, mounting the door panel 20 to the foam door body 10 or detaching the door panel 20 from the foam door body 10 becomes simple and reliable, the overall structure is simple, the replacement process is time-saving and labor-saving, and the replacement cost is saved.

Figure 17:
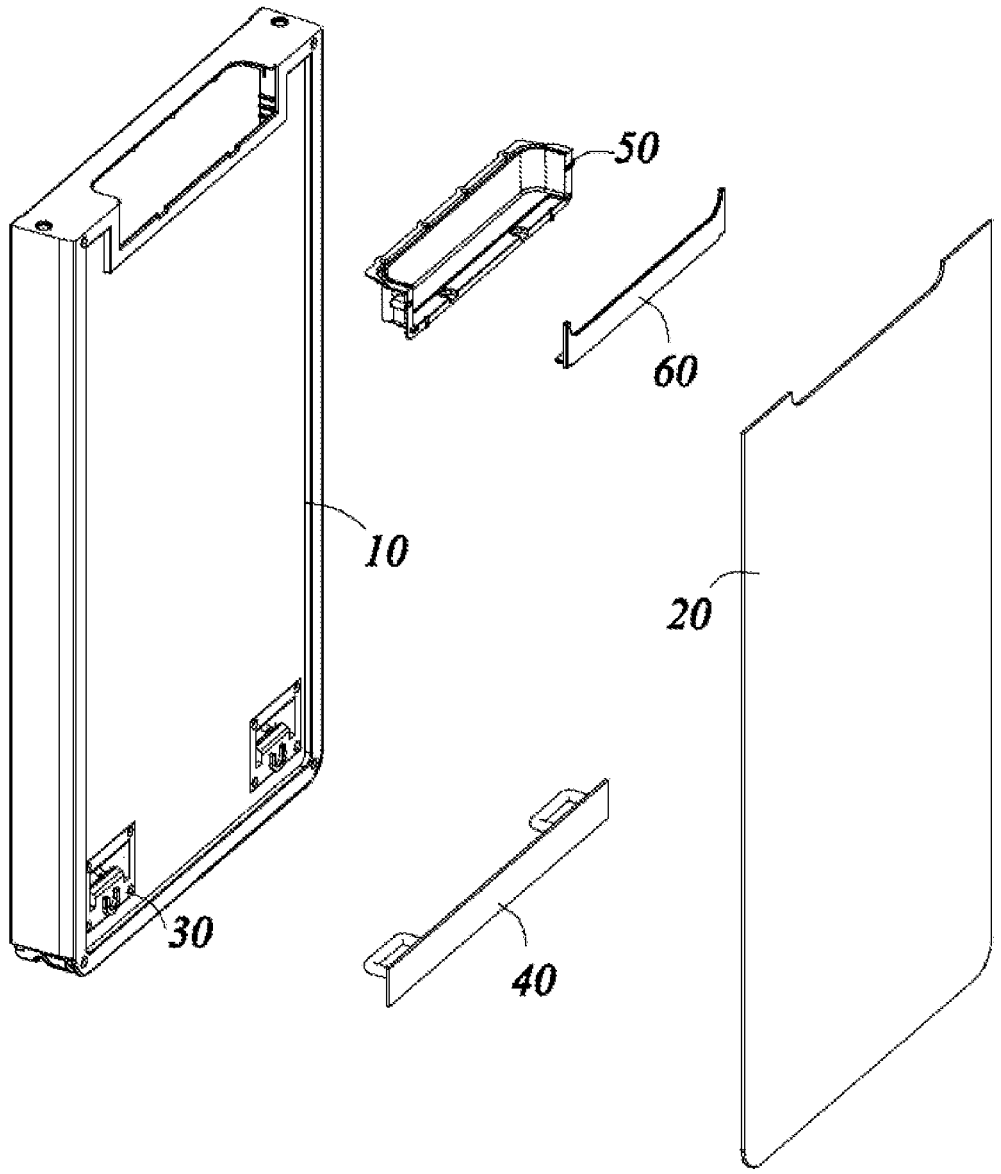
FIG. 17 is an exploded view of a refrigerator door according to a fourth embodiment of the present invention.
Figure 18:
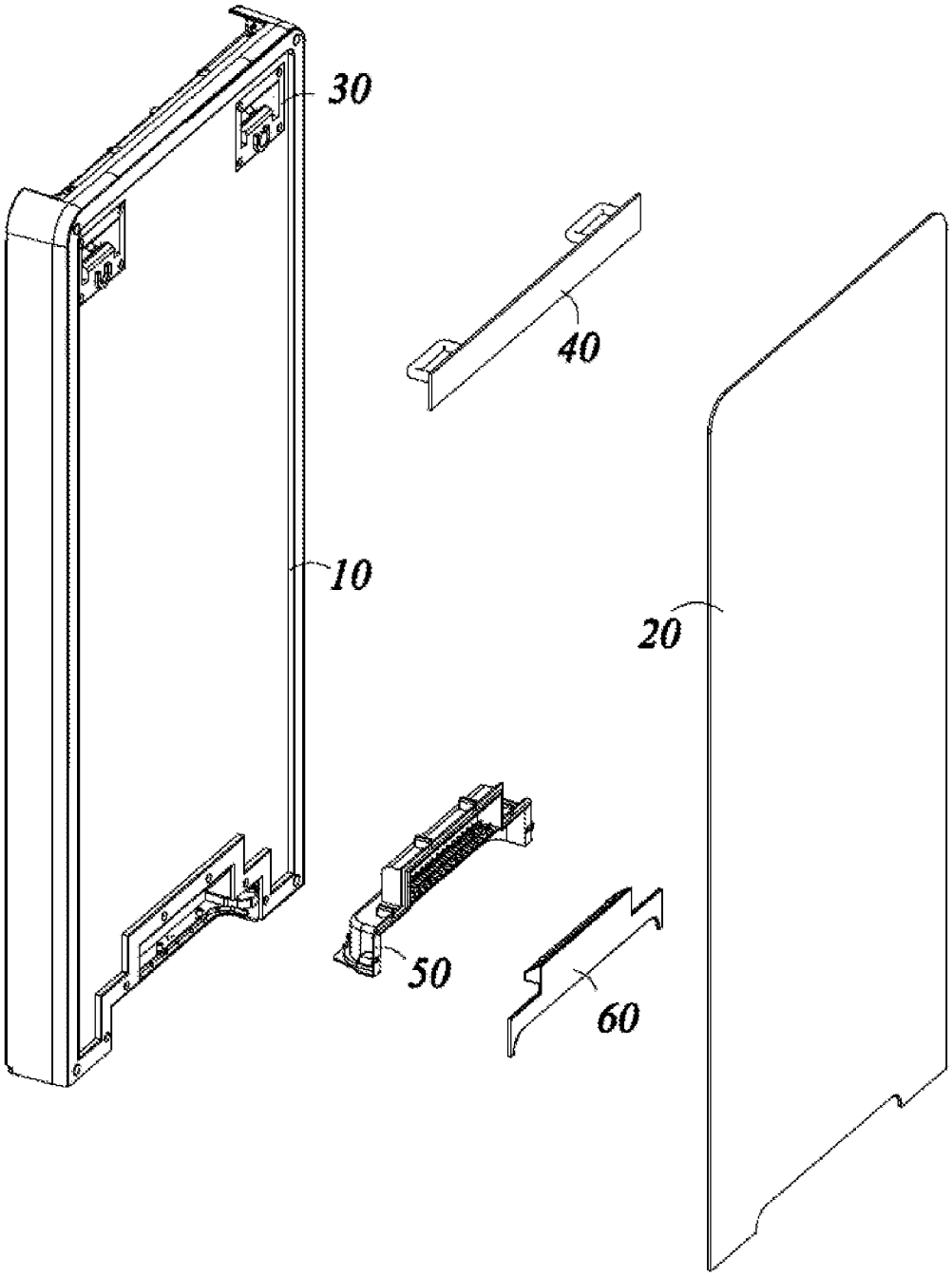
FIG. 18 is an exploded view of a refrigerator door according to a fifth embodiment of the present invention.

It should be appreciated that the refrigerator doors with replaceable door panel described in the above three embodiments may be used alone or in combination; As shown in FIG. 17 and FIG. 18, the refrigerator doors with a replaceable door panel provided by a fourth and fifth embodiments in the present invention combine the first embodiment with the second embodiment, and combines the first embodiment with the third embodiment, that is, the hidden handle, and the hook-catching portion 30 and the hook 40 that engage each other are disposed between the foam door body 10 and the door panel 20; preferably, the hook-catching portion 30 and the hook 40 are disposed far away from the hidden handle; for example, in a specific example of the present invention, as shown in FIG. 17, when the hidden handle is disposed at the upper end of the door body, the hook-catching portion 30 and the hook 40 are disposed near the lower end of the door body; as shown in FIG. 18, when the hidden door handle is disposed at the lower end of the door body, the hook-catching portion 30 and the hook 40 are disposed close to the upper end of the door body; in this embodiment, the number of the hook-catching portion 30 and the hook 40 may be specifically set according to needs, and will not be described in detail any more here.

In the fourth and fifth embodiments, the door panel 20 is mounted and detached with reference to the mounting process stated in the first embodiment and the second embodiment; in the mounting and detaching process, since the first groove 301 on the hidden handle has the third opening and the fourth opening communicated with each other, and the second groove has the fifth opening and the sixth opening communicated with each other, the structure of the hidden handle will not block the mounting process in the process of mounting and detaching the door panel 20 based on the first embodiment; taking the first groove 301 as an example, in the process of mounting and detaching the door panel 20 in the first embodiment, the second boss 63 enters the first groove 301 from the interface of the third opening and the fourth opening, and is finally positioned in the first groove 301. Detailed depictions will not be presented here.

According to the refrigerator doors with the replaceable door panel in the fourth and fifth embodiments of the present invention, through the hidden handle disposed at the interface of the foam door body 10 and the door panel 20, and the hook-catching portion and hook 40 that engage each other, the space occupied by the hidden handle on the refrigerator is used reasonably, and meanwhile the mounting of the door panel 20 to the foam door body 10 or detachment of the door panel 20 from the foam door body 10 may be made simple and reliable, the overall structure is simple, the replacement process is time-saving and labor-saving, and the replacement cost is saved.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A refrigerator door, comprising a foam door body, and a door panel detachably connected with the foam door body; wherein the foam door body comprises: a foam main body, and a hook-catching portion is inserted to a front surface of the foam main body; the door panel comprises a door panel face and a hook disposed on a rear surface of the door panel, the hook is disposed in engagement with the hook-catching portion;

wherein the hook-catching portion comprises a first groove by recessing into an interior of the foam main body relative to the front surface of the foam main body, and the first groove has a first surface disposed close to an upper end of the foam main body, a second surface connected to the first surface and disposed close to the foam main body, and a third surface and a fourth surface connected to the first surface and second surface, respectively;

the first surface is an inclined surface disposed inclined from down to up and towards outside the first groove;

the hook-catching portion further comprises a first inclined surface being configured to be spaced apart from the third surface and the fourth surface, and to protrudingly extend from the second surface to face the first surface, where the first surface and the first inclined surface are parallel to each other, a first sliding groove is formed between the first surface and the first inclined surface, and an entrance to the first sliding groove is formed between ends of the first surface and the first inclined surface to be exposed at the front surface of the foam main body; a second sliding groove is formed between the third surface and one sidewall beside the first inclined surface, and a third sliding groove is formed between the fourth surface and another sidewall beside the first inclined surface;

the hook comprises a first sliding rod disposed in parallel with the door panel, and two second sliding rods connecting the first sliding rod with the door panel;

the first sliding rod is disposed in the first sliding groove, and spaced apart from the entrance to the first sliding groove; the two second sliding rods are disposed in the second sliding groove and the third sliding groove, respectively.

2. The refrigerator door according to claim 1, wherein the first surface and the second surface are connected by a circular arc surface.

3. The refrigerator door according to claim 2, wherein a stopper is disposed extending from the second surface toward the first surface, and the stopper forms the first inclined surface; the stopper further comprises a second connecting surface facing the fourth surface, a third connecting surface disposed facing and parallel to the third surface, and a fourth connecting surface extending from the first inclined surface to the second surface.

4. The refrigerator door according to claim 3, wherein the fourth connecting surface extends from an end of the second surface away from the first sliding groove towards the first inclined surface.

5. The refrigerator door according to claim 4, wherein the fourth connecting surface comprises a first sub-connecting surface perpendicular to the second surface, and a second sub-connecting surface connecting the first sub-connecting surface with the first inclined surface, the second sub-connecting surface being an inclined surface disposed from down to up and inclined inward the first groove.

6. The refrigerator door according to claim 5, wherein a transition between the first sub-connecting surface and the second sub-connecting surface is formed as a circular arc surface, and a transition between the second sub-connecting surface and the first inclined surface is formed as a circular arc surface.

7. The refrigerator door according to claim 3, wherein the two second sliding rods being parallel to each other.

8. The refrigerator door according to claim 7, wherein the two second sliding rods are perpendicular to a rear wall surface of the door panel.

9. The refrigerator door according to claim 7, wherein the hook-catching portion is configured as a hook-catching sheet, a middle portion of the hook-catching sheet being recessed towards the interior of the foam door body to form the first groove;

a U-shaped boss is disposed on a wall surface of the hook-catching sheet facing towards the door panel and below the first groove, a U-shaped opening of the boss faces towards a top of the foam door body, and a U-shaped first positioning groove is formed on the wall surface of the hook-catching sheet facing towards the door panel;

the hook further comprises a fixing plate disposed on the rear surface of the door panel, a raised sheet protrudes in a middle of the fixing plate towards the foam door body, and the two second sliding rods are disposed on the raised sheet;

a second positioning groove is formed by inwardly recessing from a surface of the raised sheet facing towards the foam door body, at a position next to the first sliding rod, and the second positioning groove extending through a wall surface of the raised sheet facing towards the foam door body;

the refrigerator door further comprises a magnetic attraction sheet and an iron sheet which cooperate with each other in a magnetically-attractive manner;

the magnetic attraction sheet is disposed at a position on a wall surface of the hook-catching sheet facing the door panel, and corresponding to a position of the first positioning groove, and the iron sheet is disposed protrudingly from a bottom surface of the second positioning groove, and the iron sheet extends toward an opening of the second positioning groove with a protrusion height of the iron sheet not greater than a depth of the second positioning groove.

* * * * *